United States Patent [19]

Wallis

[11] 4,043,096

[45] Aug. 23, 1977

[54] AUTOMATIC PACKAGING METHOD AND APPARATUS

[76] Inventor: Marvin E. Wallis, 20741 Horace St., Chatsworth, Calif. 91311

[21] Appl. No.: 285,140

[22] Filed: Aug. 31, 1975

[51] Int. Cl.[2] ..... B65B 7/16

[52] U.S. Cl. ..... 53/41; 53/32; 53/140; 53/230; 425/516

[58] Field of Search ..... 53/3, 32, 41, 140, 230; 117/105.3, 119; 118/324, 325, DIG. 4, 50; 156/285, 500; 206/471; 427/294; 425/516; 264/92

[56] References Cited

U.S. PATENT DOCUMENTS

| | | | |
|---|---|---|---|
| 3,132,966 | 5/1964 | Hughes | 118/DIG. 4 |
| 3,178,866 | 4/1965 | Wallis | 53/140 |
| 3,307,327 | 3/1967 | Liedtke | 53/230 |
| 3,331,728 | 7/1967 | Lane | 156/285 X |
| 3,341,354 | 9/1967 | Woods | 118/324 X |
| 3,433,694 | 3/1969 | Nuttall | 53/140 X |
| 3,449,886 | 6/1969 | Connelly | 53/22 |
| 3,468,099 | 9/1969 | Vogt | 53/140 |
| 3,500,610 | 3/1970 | Chenoweth | 53/140 |
| 3,596,432 | 8/1971 | Straub | 53/140 X |
| T879,001 | 10/1970 | Horiszny | 206/471 X |

*Primary Examiner*—Travis S. McGehee
*Assistant Examiner*—John Sipos
*Attorney, Agent, or Firm*—Finnegan, Henderson, Farabow & Garrett

[57] ABSTRACT

In a packaging process in which a molten sheet of thermosetting or thermoplastic resin material is extruded and projected from a film forming head and the articles to be packaged are moved along a conveyor underlying the head so as to intercept the projected sheet of resin material and be enveloped and covered thereby, apparatus and method are disclosed for developing a suction or vacuum at a location beneath the conveyed articles substantially underlying the extruded sheet of resin. A pressure differential is created about each article, in which the pressure is substantially reduced about the lower or bottom surface so as to cause the intercepted, molten sheet of resin material to be drawn around the upper portions of the article and sealed about the perimeter of the article's bottom surface. Simultaneously with this wrapping and sealing, excess resin film is trimmed away from the article and collected in a scrap basket disposed in the air stream used in developing the suction effect. The suction further acts as a tensioning device to prevent the projected film from running with the packages. A blower unit is arranged to provide the suction at an intake opening thereof, while a discharge port of the same blower unit is disposed to direct cooling air on the packaged articles downstream of the film forming head. Also disclosed is a package including a container tray adapted to receive packageable contents and having a construction especially adapted for use in conjunction with the above-mentioned packaging process and apparatus.

3 Claims, 8 Drawing Figures

II
II

AUTOMATIC PACKAGING METHOD AND APPARATUS

BACKGROUND OF THE INVENTION

The present invention relates to method and apparatus for packaging articles and more particularly to method and apparatus for automatically covering and sealing articles with an extruded sheet of thermosetting or thermoplastic resin material.

The desirability of automated high speed equipment for packaging articles of all types and shapes is apparent. Moreover, packaging which provides a see-through film or sheet covering the article is all the more desirable as it affords visual display of the consumer article while protecting the contents from abrasion, exposure to the air, infection with germs, etc. It is a common practice today in th food industry to package meat products and other foodstuffs in container trays followed by a wrapping of clear plastic sheet or film material.

One particularly advantageous technique for providing such packages has been developed and is disclosed in my U.S. Pat. Nos. 3,008,834; 3,178,866; 3,297,809; 3,284,983; and 3,220,379. As disclosed therein, method and apparatus are provided for extruding and projecting molten film-like sheets of thermoplastic resin material and simultaneously moving the food products or other articles to be packaged along a path which intercepts the projected resin sheet causing the articles to be enveloped thereby. The molten sheet rapidly cools as it is projected from a film forming head such that as the material engages the moving article, it has sufficiently solidified to maintain its film-like continuity. The sheet or film itself is generated by extruding a liquified viscous resin material outwardly from a die or orifice constituting the critical component of the film forming head. This extrusion is performed by applying substantial pressure to the fluid at a point upstream of the extruding head.

In prior systems, such as the one disclosed in U.S. Pat. No. 3,178,866, the extruded and projected plastic sheet is tensioned during the interval between receipt of the articles to be packaged by projecting the sheet downwardly from a film forming head overlying the conveyor and engaging the downwardly depending sheet at a location underlying the path of the conveyed articles with a rotating roller surface moving at a speed slightly greater than the rate at which the film is extruded. While this arrangement has been found suitable for some packaging operations, it only provides tensioning of the film at the time that the leading edge of the article intercepts the sheet. Once this interception occurs, the moving article redirects the downwardly depending sheet, such that the tensioning effect of the roller is disrupted. Coverage of portions of the article to the rear of the leading edge depend upon the gravitational forces operating on the extruded film. Such forces are not substantial enough to snug the material down and seal it to the article.

Furthermore, wrapping of the articles in this manner results in tails or trailing pieces of film which must be removed in a separate operation to complete the package. Also this technique does not afford wrapping of the sides of such articles.

SUMMARY OF THE INVENTION AND ITS OBJECTIVES

Accordingly, it is an object of the present invention to provide an improved method and apparatus for tensioning the projected plastic sheet in a packaging process of the type described above.

It is a further object of the present invention to provide method and apparatus for pulling the projected molten film snugly about the articles to be packaged and for simultaneously sealing the plastic or resin material to the article.

A still further object of the present invention is to automatically pull the plastic sheet tightly around the article and simultaneously trim and carry away excess plastic film so as to eliminate tails or trailing pieces of film material.

An additional object of the invention is to provide method and apparatus for tightly wrapping the extruded plastic sheet about the articles as they are conveyed into the packaging area and tucking edges of the film under the article's bottom and sealing the film about the perimeter thereof.

It is an advantage of the present invention that the wrapping and sealing of the article directly from the extruded molten sheet of plastic material, eliminates the hygienic deficiencies of many other types of plastic sheet packaging techniques. In this regard, for many years the clean shiny plastic sheet that comes off a new roll of material was considered hygienicaly acceptable in the packaging of fresh food products. However, bacteriologists have proven that such clear shiny plastic film actually has more bacteria per square inch than an ordinary piece of brown wrapping paper. For example, the bacteria count on a fresh sheet of plastic film from a new roll ranges from 8 to 20 colonies per square inch while the fiberboard box which the plastic sheet is intended to shield and protect the food products from, will typically carry only 1 to 3 colonies per square inch. The explanation advanced for this fact lies in the static electricity inherently present on plastic sheet material.

In contrast, the plastic material applied by methods and apparatus such as the present invention are hygienically superior in that the material is applied to the article, such as a foodstuff, at a controlled temperature range of 140° to 200° F, so as to effect a flash pasturization of the surface in which it comes into contact. Furthermore, moments before the extruded plastic or resin material reaches the article, its temperature was 400° F and thus substantially bacteria free. The complete sealing of the film to the article by reason of the improvement of the present invention, such as the sealing to the bottom of a food carrying tray, complements the hygienically superior characteristics of this type of packaging process.

Another advantage of the present invention is that the article may be packaged in a container or tray which itself is impervious to air or liquids. This contrasts with one presently used packaging process in which the products to be packaged are arranged on treated porous boards. The items so arranged are covered with a sheet of plastic material that is thereupon heated to a point at which the plastic material becomes soft and pliable. A vacuum is then pulled through the porous space underlying the product, sucking the sheet down around the item or items and sealing the plastic to the prepared board or base. Of course, although the plastic cover of the article is sealed, the interior of the package is not sealed because of the porous bottom. A further disadvantage of this technique is in the requirement of excessive heat to soften the plastic material while it overlies the article. Slow speed, cost, and the requirement of follow-up trimming are further shortcomings.

An additional advantage of the present invention is that it automatically provides for trimming away excess film, simultaneously as the article is wrapped and sealed. Furthermore, only a small amount of material is actually tucked under and sealed to the bottom of the article thus saving on material and producing a clean, neat looking package. Previous plastic sheet wrapping techniques involve the formation of heavy folds, sealed on the bottom and ends of the article or food tray to be packaged. Also, some of these methods involve the application of heat to the bottom of the article to form a seal of the bunched or folded film thereat. This method is slow and the resulting packages have a sloppy appearance, unpleasant to the customer's eye.

Briefly, these objects and various advantages are achieved by an improvement in combination with my previously disclosed packaging equipment. This improvement involves method and apparatus for developing a pressure differential or partial vacuum in the atmosphere or air surrounding each article as it is moved to intercept the extruded and projected film of plastic material. This pressure differential is preferably provided by drawing a vacuum or suction at a location immediately beneath the conveyed articles and in underlying registration with a downwardly projected molten film emanating from an overlying film forming head. The developed suction tensions the film or sheet prior to interception by the article. Moreover, as the article moves into intercepting relation with the sheet, the suction developed at the article's bottom increases and causes the film material to be pulled around and over the front, upper and side surfaces of the article, tucking portions of the molten sheet to the lower peripheral edge of the bottom and at the same time sealing it thereto. Special arrangements may be employed for providing a positive seal of the material to the rear of the package.

In addition to the enveloping and sealing of the film to the article, excess film material is torn away from the seals along the article's bottom and removed from the wrapping station by an airstream used in developing the suction. A scrap collection basket is disposed within this airstream to collect the film scrap.

In a preferred form of the present invention, a specially designed container tray is employed in combination with the foregoing apparatus and method, wherein a horizontally disposed rearwardly directed flange adjacent a top edge of the container provides a suitably disposed surface to which a trailing edge of the projected film seals. This container flange is provided with a perforated tear line to facilitate removal of the package covering.

In the preferred and disclosed embodiment, a high speed, high volume air blower unit is provided with an intake opening therefor arranged beneath the conveyor and film forming head for providing the necessary suction or vacuum discussed above. As a feature of this preferred embodiment, this blower unit is provided with an exhaust port arranged to direct cooling air against the wrapped packages downstream of the wrapping station so as to prevent these packages from becoming stuck together while still in a tacky state.

These and further objects and various advantages of the method and apparatus according to the present invention will become apparent to those skilled in the art from a consideration of the following detailed description of an exemplary embodiment thereof. Reference will be made to the appended sheets of drawings in which:

DESCRIPTION OF THE PREFERRED EMBODIMENT

Figures 1, 7, 8:
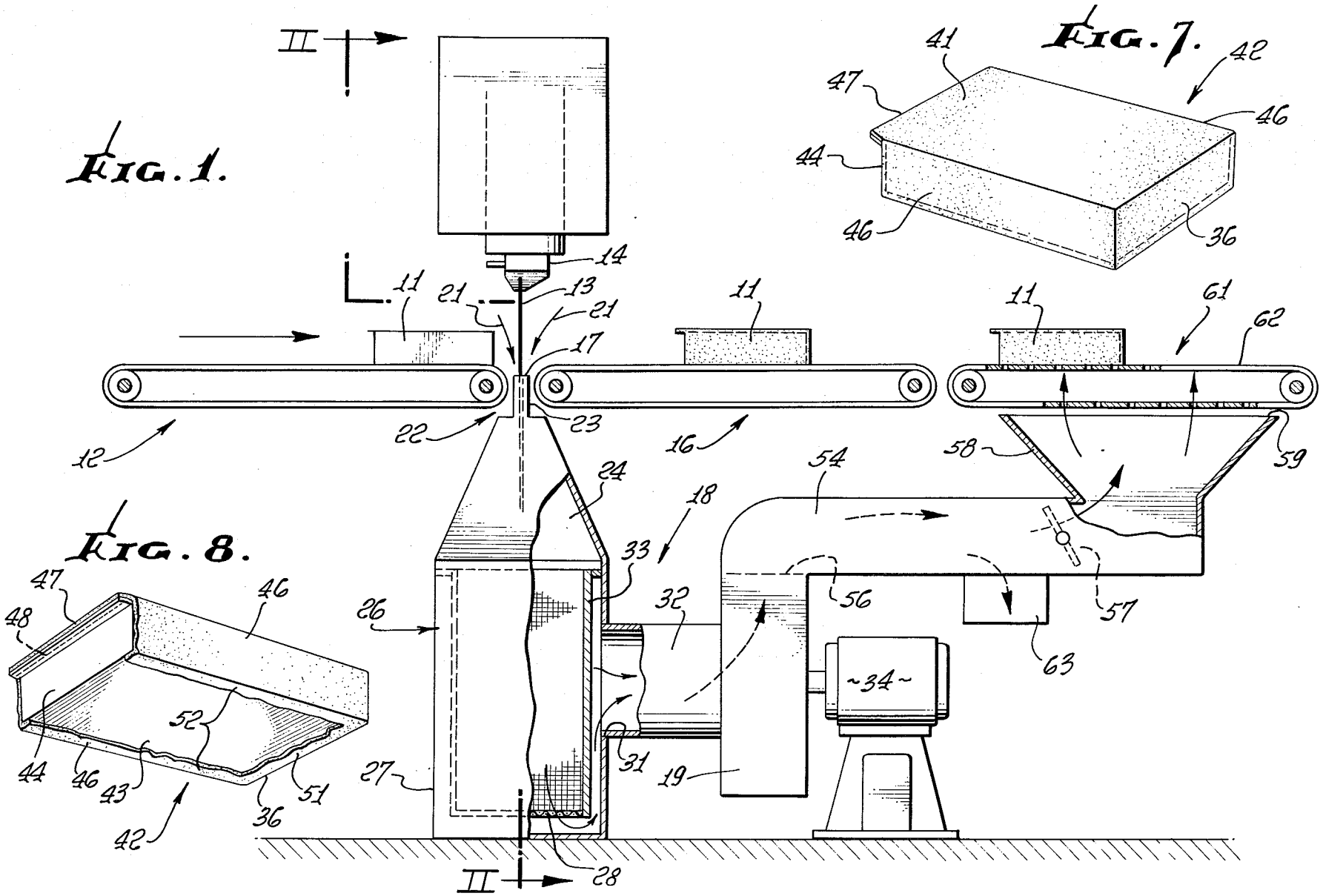
FIG. 1 is a elevational view of the packaging apparatus constructed in accordance with the present invention.
FIG. 7 is an enlarged perspective view of a food tray or the like wrapped in a see-through plastic or resin cover after being packaged by the apparatus shown in FIG. 1.
FIG. 8 is a perspective view of the wrapped tray of FIG. 7 as seen from the bottom thereof illustrating the sealing of the extruded plastic sheet to the perimeter of the article's bottom as is automatically provided in accordance with the operation of the present invention.

With reference to FIG. 1, the articles 11 to be packages are carried by an infeed conveyor 12 at a rapid rate into intercepting relationship with an extruded and projected film or sheet 13 of molten resin material, generally in the same manner as described in my previously issued U.S. Pat. No. 3,178,866. However, in accordance with the present invention and as illustrated in FIGS. 1 through 6, sheet 13 is tensioned by developing a pressure differntial or partial vacuum in the region surrounding the point of interception of articles 11 therewith. Moreover, this pressure differential provides for a relatively reduced pressure adjacent the surfaces of article 11 remote or opposite from a film forming head 14 such that as each article intercepts and becomes enveloped in molten sheet 13, the film material is rapidly and automatically tucked around the front and sides of the article, and tucked and sealed to the bottom thereof. Simultaneously, excess plastic or resin film is automatically trimmed away from the article to complete the wrapped package for delivery away from the wrapping station by a discharge conveyor 16.

The differential pressure or partial vacuum for the automatic wrap and trim of article 11 is preferably provided by a relatively high volume pull of air into a suction opening or orifice 17 formed at the intake port of a large volume high speed blower unit indicated generally at 18. A centrifugal fan or blower 18 draws air into orifice 17 such that a controlled air movement as indicated by arrows 21 adjacent sheet 13 serves to envelope the sheet or film about each of the articles and simultaneously cool the projected and still molten plastic film. Immediately at orifice 17, a strong suction is developed at a location on the opposite side of articles 11 from film forming head 14, in this instance corresponding to the bottom of the articles resting on conveyors 12 and 16. It is the suction adjacent the lower surface of the articles which causes the still molten film to tuck under each article's bottom and seal to the perimeter thereof. Simultaneously, excess film is torn away from the article.

Figure 2:
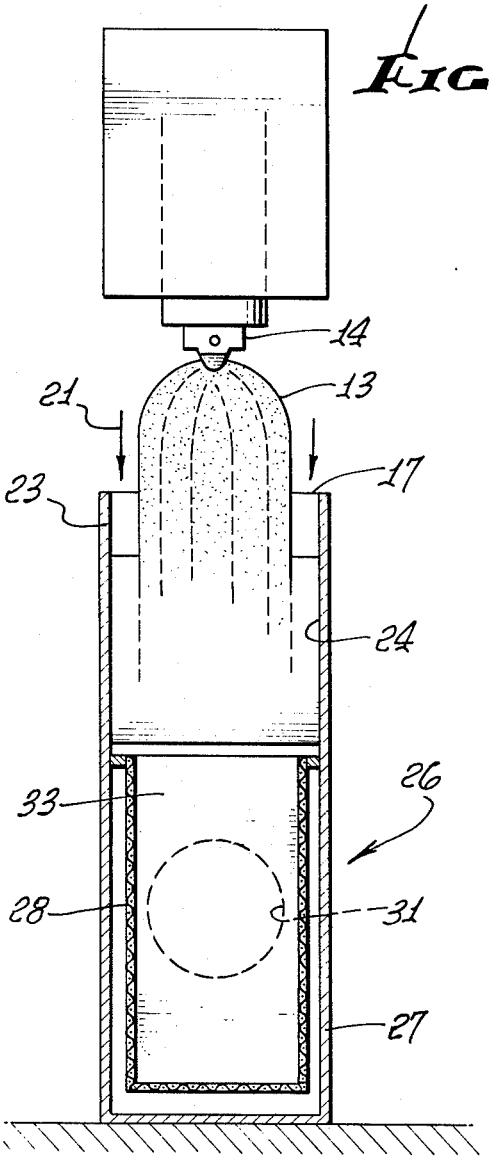
FIG. 2 is an enlarged sectional view taken along planes II—II of the apparatus of FIG. 1, illustrating the extruded plastic or resin sheet being projected downwardly into a suction intake of a blower unit.

For most articles, it is preferable to form orifice 17 with an elongate generally rectangular throat, having the longitudinal dimension extending taansverse to the path of the conveyed articles and in registration with the width of the projected resin sheet 13 as best shown in FIGS. 1 and 2. Furthermore, the upper perimeter of orifice 17 is arranged relative to conveyors 12 and 16 so as to be immediately below the lower surface of the articles as illustrated. Here, a transverse break or opening 22 is provided between infeed conveyor 12 and discharge conveyor 16 so as to accommodate elongate orifice 17.

A rectangular intake duct 23 defining orifice 17 at the upper perimeter thereof communicates this suction orifice with a chamber 24 having downwardly and outwardly sloping walls as shown in FIG. 1 where the lower perimeter of chamber 24 is joined to the upper perimeter of a scrap accumulator assembly 26. Assembly 26 is comprised of an upstanding chamber 27 and an interiorly conforming perforated scrap collection basket 28. Basket 28 is thus disposed in the air stream connecting blower 19 to intake duct 23 so as to intercept film scrap pulled into orifice 17, during the automatic wrapping and trimming operation.

Blower 19 draws air through basket 28 by means of a circular side port 31 communicating with a circular intake port of blower 19 via a cylindrical duct 32 as shown in FIGS. 1 and 2. A solid baffle 33 carried by the side of basket 28 adjacent port 31 provides for redistribution of the air stream for more even accumulation of scrap. Assembly 26 is constructed such that basekt 28 is removable from chamber 27 or is otherwise accessible for periodic cleaning.

It will be appreciated that the large volume flow of air when pulled on the relatively small cross-section of duct 23 and orifice 17 develops a substantial suction at the packaging station. In particular, a vacuum pull of one-half to three inches of mercury, measured in chamber 24, has been found suitable for the wrapping and trimming operation. Suitable means, such as motor 34 provides for driving blower 19.

Returning to the packaging station itself, the semi-solid, still molten material forming sheet 13 may be any of a variety of thermal setting or thermal plastic resins having a proper melt index, viscosity, transparency or color, tensile strength, resistance to penetration by air, water, etc. as disclosed in my previously mentioned U.S. Pat. No. 3,178,866. However, preferably, the extrusion and projection of sheet 13 is generated by a film forming head of the type set forth in my co-pending U.S. application Ser. No. 286,116 filed Sept. 5, 1972, entitled "Film Forming Head "now U.S. Pat. No. 3,861,850. This head develops a bi-axially oriented film from a highly viscous resin in which the resin molecules are stretched in bi-axial directions during the extruding process. This improves the strength of the sheet in all directions of an applied tear force and also increases the sheet's clarity. With reference to FIG. 2, such a bi-axially oriented sheet 13 is shown being projected from head 14 such that the extruded film has both vertically and horizontally extending components.

Prior to interception of sheet 13 by one of the articles, the sheet is tensioned in a downwardly direction as shown in FIG. 2 by the suction developed at orifice 17. The construction of intake duct 23 is designed to provide a longitudinal dimension for orifice 17 greater than or at least equal to the width of film 13 as shown. Furthermore, this dimension of orifice 17 should be greater than the largest tray or article to be wrapped. The maximum width of standard grocery store trays is approximately 10 inches, and accordingly here, a longitudinal dimension for orifice 17 has been selected to be 11 inches. The dimension in the direction of conveyor travel has been selected to be approximately $\frac{3}{4}$ to 1 inch.

As the controlled air movement illustrated by arrows 21 in FIG. 2 is flowing into orifice 17 evenly on both sides and edges of sheet 13, it holds its projected shape as indicated. When the semi-solid, molten material hits the rapidly moving cooling air flowing into orifice 17, the resin material cools and hardens quickly since there is no mass in the material to resist such cooling. By the time the material has reached basket 28 it is in a shrivelled and partially disintegrated state and can be held until sufficient scrap has accumulated to necessitate its removal. Although a scrap accumulating basket 28 is here illustrated, other methods of gathering and carrying away the scrap can be employed such as a conveyor or a vacuum transfer system.

Figure 4:
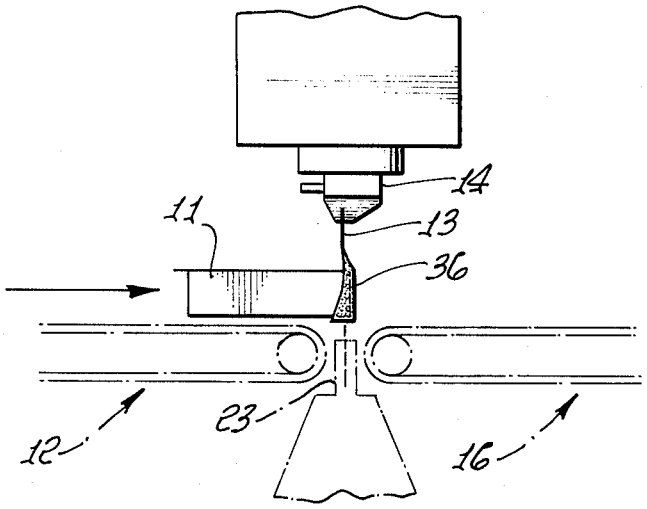
FIG. 4 is an enlarged fragmentary side elevation view as seen from IV—IV of FIG. 3 showing the interception of the articles leading edge with the downwardly projected molten sheet of plastic.
Figure 5:
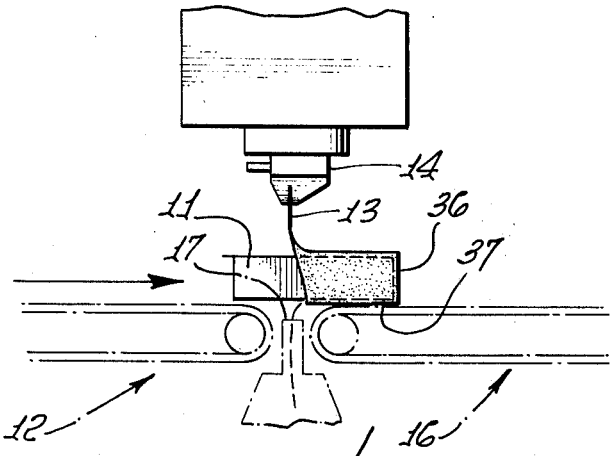
FIG. 5 is a view similar to FIG. 4 illustrating an advanced stage of the enveloping and wrapping operation of the article as it proceeds under the film extruding head.
Figure 3:
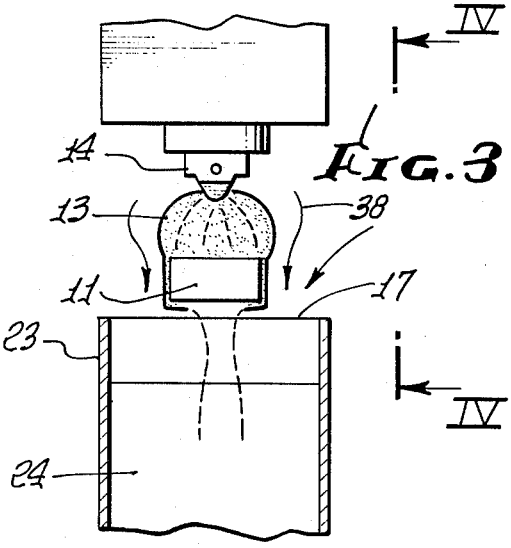
FIG. 3 is a view similar to FIG. 2 illustrating the manner in which the projected resin sheet envelops an article carried into intercepting relationship therewith by a conveyor means.

With reference to FIGS. 3 and 4, the suction tensioning of sheet 13 holds it firmly such that the front or leading edge of each of articles 11 intercept the molten film as shown. The articles are transported by the conveyor means such that they move into interception with the film along a path generally perpendicular to the film plane. This initial engagement with the film causes the resin sheet to engage and seal a front 36 and a leading peripheral bottom edge 37 of the article. Since sheet 13 is wider than article 11 as shown in FIG. 3, the film material is held firm along the sides of the product as well as in the front. As article 11 moves to a mid-point at the wrapping station as shown by FIG. 5, the partial blockage of orifice 17 by the article itself causes an increase in the suction along the article's sides. This side suction pulls the film tightly around the sides and tucks it underneath the bottom along the peripheral edges thereof adjacent the sides. A significantly reduced pressure at the bottom, also caused by the overlaying relation of article 11 to orifice 17 causes the film to be pulled into engagement with the sides and bottom and with the air being partially evacuated from between the film and the surface of the article. As the resin material is still in a partially molten condition, this engagement of the film with the articles' sides and bottom causes a seal to be formed therebetween. Excess film is pulled away from these sealed portions and conveyed through intake duct 23 for accumulation in basket 28.

While mid-portions of article 11 overlie orifice 17 the full flow of air stream directly into the intake duct is deflected as shown by arrows 38 in FIG. 3. Instead of the film flowing directly downwardly in a vertical path along the sides of the article, it is deflected horizontally inwardly of its normal path. Increasing suction on the bottom pulls the film in and around the sides and underneath the bottom to extend inwardly along the perimeter thereof adjacent the articles' side ⅛ of an inch to 1½ depending on the condition of the film and the shape and size of article 11.

Figure 6:
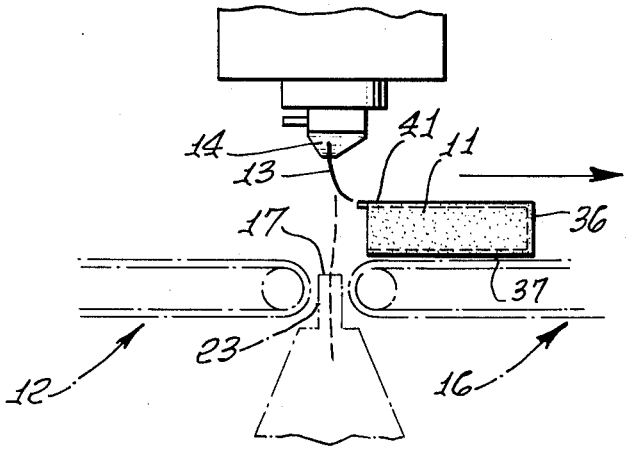
FIG. 6 is still another view similar to FIGS. 4 and 5 showing in this instance a final stage of the wrapping operation in which the sheet of resin material is torn away from the completed package and the now wrapped article is carried away from the extruding head by a discharge conveyor.

With reference to FIG. 6, wrapping of each of articles 11 is completed as sheet 13 envelops and seals to an upper peripheral edge 41 of the product. As this occurs article 11 has moved past its previously overlying relationship with orifice 17. Now, sheet 13 is pulled directly downwardly by the strong air suction developed at orifice 17 causing the film material to tear away from the rear edge of article 11 and resume its downwardly depending tensioned condition in preparation for receipt of the next article.

As the sheet 13 does tend to be pulled away from article 11 at the back portion thereof, it has been found preferable to provide means, either on the article itself, or in the manner in which these articles are disposed on conveyors 12 and 16, so as to effect a positive seal at the article's trailing edge. I have discovered one advantageous approach which I prefer. With reference to FIGS. 6, 7, and 8, a thin wall tray container 42 is provided having a generally rectangular open top box configuration comprised of a generally flat planar bottom 43, a front 36, a back 44, and a pair of sides 47 for receiving contents, such as meats, other food-stuffs, etc., to be packaged therein.

Moreover, container 42 for use in combination with the previously described method and apparatus of the invention is formed with a rearwardly extending flange 47 connected along the upper edge 41 of back 44. As container 42 with its contents therein moves as an article 11 described above and as shown in FIG. 6, sheet 13 is pulled down into engagement with an upper surface of flange 47 and forms a positive seal therewith completing the package wrap. Now, the opening of container 42 is surrounded by a positive sealing engagement of the resin film or cover with an exterior surface portion of the tray.

A further feature of tray 42 in accordance with the present invention is the provision of a perforated tear line 48 on flange 47 proximate and parallel to edge 41. A consumer thus, may tear the free edge portion of flange 47 away from tray container 42 causing a release of the film seal adjacent edge 41 to facilitate removal of the plastic wrapping.

Thus the present invention provides a packaged article having the preferred form as illustrated in FIGS. 7 and 8, in which a tray container 42 filled with its contents is arranged on infeed conveyor 12 as articles 11 and processed in accordance with the foregoing description. The resulting package provides a plastic film or sheet which covers front 36, sides 46, leading and side perimeters 51 and 52 respectively of bottom 43 (as shown in FIG. 8) and an upper surface of flange 47. The covering may be of a clear plastic to afford display of the contents. Hygienically the covering is superior to many other clear plastic packages in that the sheet has been extruded at a very high temperature immediately prior to the wrapping operation and sealed to the surface portions of the container surrounding its open top before the material has had a chance to collect bacteria.

Alternatively to the provision of a rearwardly facing flange 47 on container 42, open top containers without such a flange and other articles having an upright rear wall may be adequately sealed by disposing the articles on conveyor 12 in a tilted fashion with the leading edge down and the trailing edge up. This orients the otherwise upright or vertical rear wall of the container or article such that it now has a horizontal component, sloping upwardly and toward head 14 while in the infeed side of the wrapping station. This sloping orientation of the rear wall, although not illustrated in the drawings, provides for accommodating the trailing edge of sheet 13, engaging and sealing therewith so as to complete the wrap at the rear wall portion of the article. Further, if the rear of the tray is not filled within ⅛ inch of the rear wall, the film will sweep down in the tray and seal to that portion, of the rear wall above the products. Still another alternative, acceptable in some cases, such as frozen steaks, cheese, etc., is to run each of articles 11 through the packaging apparatus twice, first with the front leading and the next time in which the article is rotated 180° such that the back is leading.

Although the speed at which articles 11 are moved along conveyors 12 and 16 may be adjusted, along with correlated adjustments of the rate of sheet extrusion by head 14 and the tension or suction developed by blower unit 18, it has been found that the packaging apparatus should be run at a fairly rapid rate. For most articles, a conveyor transport rate in the range of 375 to 500 feet per minute has been found suitable. In this regard, it will be appreciated that the articles are moved into engagement with the projected plastic sheet 13 at such a rapid rate that some cooling of the film by the controlled air movement about the film developed by the suction at orifice 17 is desirable. On the other hand, too much cooling would prevent the application of the plastic sheet while still in its semi-molten condition, whereas the molten condition is preferred because of its superior sealing characteristics to the article.

Another feature of the present invention is that blower unit 18 in addition to developing the suction at orifice 17 also provides for cooling the packaged articles 11 on the discharge side of the apparatus. For this purpose a discharge duct 54 is connected to an output port 56 of blower 19 and extended through a damper 57 to an exhaust diffuser 58. The discharge opening 59 of diffuser 58 is arranged to immediately underlie a cooling station 61 provided by a perforated belt conveyor 62 as illustrated in FIG. 1. Since the packaging operation is conducted at the relatively high speeds mentioned above, the products may still be warm and the plastic tacky, adjacent the discharge side, causing packaged articles 11 to weld or stick together in the event they make contact. However, in accordance with the present invention cooling air exhausted through diffuser 58 is forced upwardly through conveyor 62 circulating air about articles 11, cooling the newly wrapped plastic film thereon. Damper 57 serves to adjust the flow of air through diffuser 58 such that excess output air from blower 56 may be vented through ducts 63.

It is understood that the present invention has been disclosed by reference to a particular and preferred embodiment thereof, and modifications and design changes may be made to the disclosed embodiment without departing from the scope of the invention.

I claim:

1. In a packaging process in which a molten sheet of resin material is extruded and projected from a film forming head through an opening in a conveyor and the articles to be packaged are conveyed so as to intercept such sheet above the opening and be at least partially wrapped thereby, the improvement in combination therewith comprising: the steps of developing a partial vacuum, while the molten sheet is extruded and projected, by the rapid withdrawal of air from beneath unsupported portions of said articles at a location aligned with said projected sheet as the articles intercept said sheet, to cause said sheet to wrap about and form a seal with each article, and breaking and trimming away excess film from said articles by said rapid withdrawal of air and carrying it away therein.

2. In a packaging process in which a molten sheet of resin material wider than articles to be packaged is extruded and projected from a film forming head and the articles to be packaged are conveyed so as to intercept such projected sheet, the improvement comprising in combination therewith the step of drawing a partial vacuum on a surface of each article remote from said head as such article intercepts said molten sheet so as to simultaneously pull said sheet including the edges of said sheet about portions of said article by said partial vacuum so as to engage and seal said sheet to peripheral portions of said article surface and tear and separate surplus material therefrom, said articles being in the form of open top containers and said containers being conveyed as said articles toward said projected sheet with the container front leading, drawing said partial vacuum on the exterior surface of said container bottom as said sheet is intercepted, and pulling the sheet by said partial vacuum under the leading edge of said bottom surface and around and under the sides of the container, sealing the sheet to the adjacent peripheral edges of the bottom surface while simultaneously covering the top opening of the container and completing the packaging by sealing the sheet to the back of said container, and breaking and trimming away excess film from said containers by the rapid withdrawal of air and carrying it away therein.

3. The improvement in claim 2 further defined by sealing said sheet to a rearwardly extending flange provided on the container along the edge of the back thereof adjacent the top opening.

* * * * *